US011063392B2

(12) United States Patent
Adachi et al.

(10) Patent No.: US 11,063,392 B2
(45) Date of Patent: Jul. 13, 2021

(54) ELECTRONIC DEVICE HOUSING THAT PERMITS REMOVAL OF DAMAGED PLUG FROM JACK WITHIN THE HOUSING

(71) Applicant: Panasonic Intellectual Property Management Co., Ltd., Osaka (JP)

(72) Inventors: Haruka Adachi, Osaka (JP); Goichi Matsuda, Osaka (JP); Kiyoshi Yokota, Osaka (JP); Takayasu Ono, Osaka (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 0 days.

(21) Appl. No.: 16/797,806

(22) Filed: Feb. 21, 2020

(65) Prior Publication Data

US 2020/0295510 A1 Sep. 17, 2020

Related U.S. Application Data

(60) Provisional application No. 62/816,851, filed on Mar. 11, 2019.

(51) Int. Cl.
*H01R 13/635* (2006.01)
*H01R 13/453* (2006.01)
(Continued)

(52) U.S. Cl.
CPC ..... *H01R 13/635* (2013.01); *H01R 13/453* (2013.01); *H01R 24/58* (2013.01); *H01R 2107/00* (2013.01)

(58) Field of Classification Search
CPC .. H01R 24/58; H01R 2107/00; H01R 13/447; H01R 13/4538; H01R 13/633
See application file for complete search history.

(56) References Cited

U.S. PATENT DOCUMENTS 7,922,543 B1 * 4/2011 Chen ..... H01R 13/703 439/668
9,887,492 B2 * 2/2018 Umehara ..... H01R 13/4538
(Continued)

FOREIGN PATENT DOCUMENTS

CN 202050088 11/2011
CN 203690620 7/2014
(Continued)

OTHER PUBLICATIONS

Extended European Search Report dated Jul. 15, 2020 in corresponding European Patent Application No. 20158195.6.

*Primary Examiner* — Vanessa Girardi
(74) *Attorney, Agent, or Firm* — Wenderoth, Lind & Ponack, L.L.P.

(57) ABSTRACT

An electronic device includes a jack including a first opening portion through which a plug can be inserted along a first axis, and coming into contact with the plug at an electrode; and a housing formed separately from the jack. The jack includes a second opening portion facing the first opening portion along the first axis, and a through-hole connecting the first opening portion and the second opening portion along the first axis. The housing includes a third opening portion opening on a same side as the first opening portion and opening at a position where a plug can be inserted from outside the housing into the first opening portion, and a fourth opening portion facing the third opening portion along the first axis and opening at a position where the plug can be discharged to an outside of the housing through the second opening portion.

11 Claims, 6 Drawing Sheets

(51) Int. Cl.
*H01R 24/58* (2011.01)
*H01R 107/00* (2006.01)

(56) References Cited

U.S. PATENT DOCUMENTS

| | | | |
|---|---|---|---|
| 2005/0208783 | A1 | 9/2005 | Suzuki et al. |
| 2013/0149029 | A1 | 6/2013 | Changsrivong et al. |

FOREIGN PATENT DOCUMENTS

| | | |
|---|---|---|
| CN | 106961049 | 7/2017 |
| CN | 207009806 | 2/2018 |
| JP | 6-29036 | 4/1994 |
| JP | 2001-297824 | 10/2001 |
| JP | 2005-267943 | 9/2005 |
| JP | 2005-332671 | 12/2005 |
| JP | 2013-122319 | 6/2013 |
| JP | 2014-182921 | 9/2014 |

* cited by examiner

ELECTRONIC DEVICE HOUSING THAT PERMITS REMOVAL OF DAMAGED PLUG FROM JACK WITHIN THE HOUSING

TECHNICAL FIELD

The present disclosure relates to an electronic device using a jack electrically connected to an inserted plug and a housing.

BACKGROUND

Japanese Patent Unexamined Publication No. 2005-267943 discloses a structure that can prevent a plug and a cable connected to the plug from being damaged and broken, or reduced in function due to excessive stress. An adapter inserted into the jack and a plug main body are connected by a magnetic force. When a force higher than the magnetic force acts on the cable, the plug is detached from the adapter, thereby preventing poor contact or disconnection from occurring.

SUMMARY

In the related art, when the plug is damaged inside the jack, it cannot be easily picked up, and there is a problem that a product needs to be disassembled or replaced in order to reuse the product. There is also a problem that an electrical connection failure occurs due to a part of the damaged plug being left inside the jack.

The present disclosure provides a mechanism by which a damaged plug can be removed without disassembly of the product and the product can be reused without replacement.

An electronic device according to one aspect of the present disclosure includes: a jack including a first opening portion through which a plug can be inserted along a first axis, and coming into contact with the plug at an electrode; and a housing formed separately from the jack. The jack includes a second opening portion facing the first opening portion along the first axis, and a through-hole connecting the first opening portion and the second opening portion along the first axis. The housing includes a third opening portion opening on a same side as the first opening portion and opening at a position where a plug can be inserted from outside the housing into the first opening portion, and a fourth opening portion facing the third opening portion along the first axis and opening at a position where the plug can be discharged to an outside of the housing through the second opening portion.

An electronic device according to another aspect of the present disclosure includes a jack including a first opening portion through which a plug can be inserted along a first axis, and coming into contact with the plug at an electrode; a housing formed separately from the jack; and an extrusion member having a projection portion and an operation portion. The jack includes a second opening portion facing the first opening portion along the first axis, and a through-hole connecting the first opening portion and the second opening portion along the first axis. The extrusion member is disposed at a position where the projection portion can be inserted into the through-hole from the second opening portion by operating the operation portion. The housing includes a third opening portion opening on a same side as the first opening portion and opening to a position where the plug can be inserted from outside the housing into the first opening portion.

An electronic device according to the present disclosure is an electronic device including a jack having a through-hole into which a plug is inserted, and a housing installed on a back surface of the through-hole and having an opening portion which is vacant at a position corresponding to the through-hole. Therefore, the plug damaged inside the jack can be discharged to the outside using the hole of the housing.

An electronic device having a plug clogging prevention mechanism according to the present disclosure is capable of discharging the damaged plug without disassembling a product to which the electronic device is attached. Therefore, even a product installed in a housing or a device that is not easy to remove can be repaired in a short time.

Further, by setting the hole vacant in the housing to a size with which a tool using for attaching the electronic device to the product can be inserted, an attaching operation can be performed without preparing a dedicated tool.

DESCRIPTION OF EMBODIMENTS

Embodiment 1

Embodiment 1 will be described below with reference to FIGS. 1 to 4.

1-1. Constitution

Figure 1:
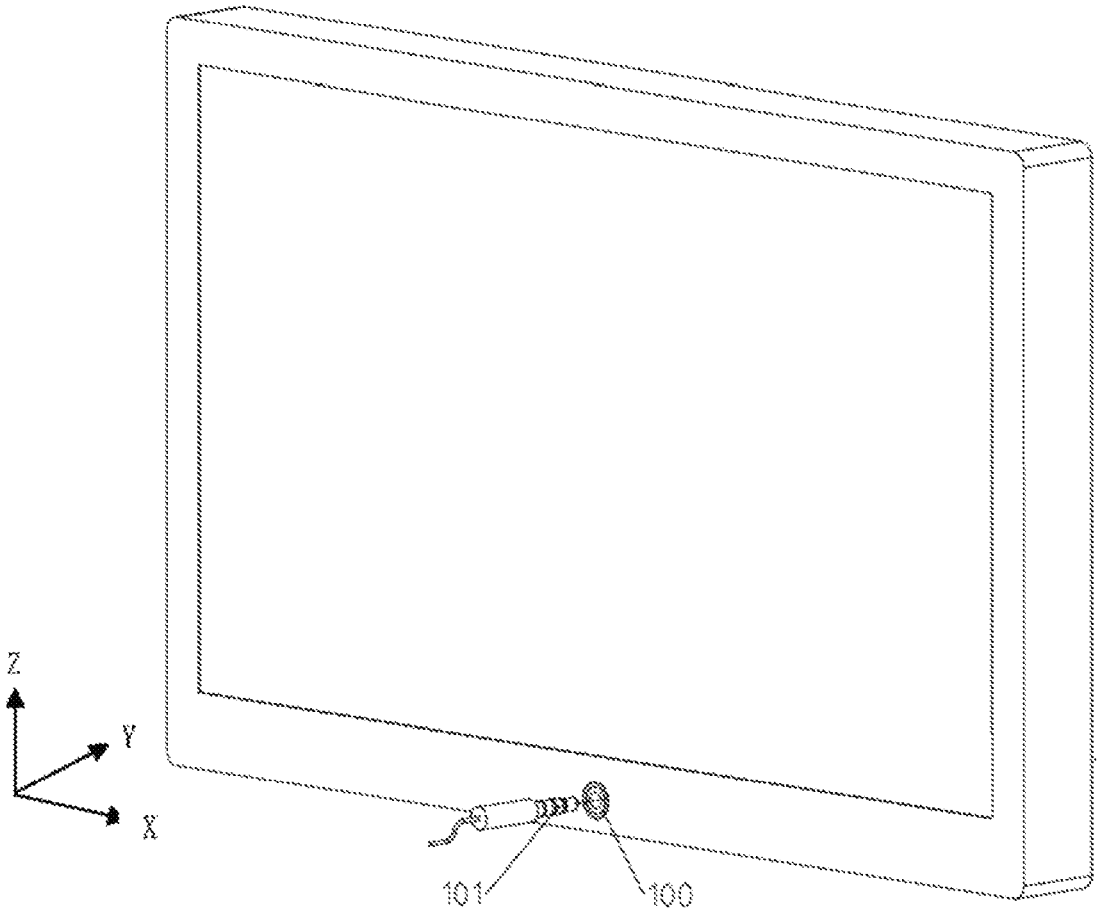
FIG. 1 is an external view of an electric product example using an electronic device of the present disclosure.

FIG. 1 illustrates an external view of a product example using electronic device 100 of Embodiment 1.

Figure 2:
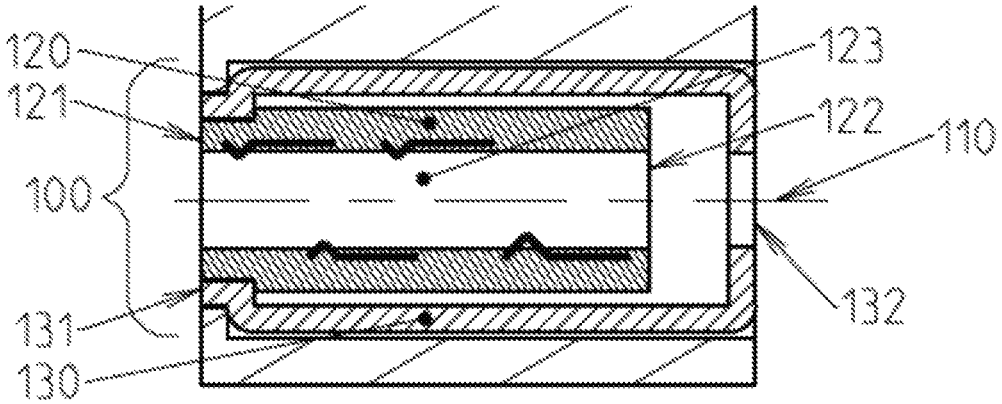
FIG. 2 is a sectional view of an electronic device in Embodiment 1.

FIG. 2 illustrates a partial sectional view of electronic device 100 in Embodiment 1.

FIG. 2 is a sectional view of an electronic device 100 portion in FIG. 1, which is taken along an X-axis.

Electronic device 100 includes jack 120 into which plug 101 is inserted, and housing 130 into which the jack 120 is incorporated. Jack 120 includes through-hole 123 formed along first axis 110 into which plug 101 is inserted, first opening portion 121 opening to a side of through-hole 123 into which plug 101 is inserted, and second opening portion 122 facing first opening portion 121 and opening on a side opposite to the side of through-hole 123 into which plug 101 is inserted. Housing 130 includes third opening portion 131 opening on a same side as first opening portion 121, and opening at a position where plug 101 can be inserted into first opening portion 121, and fourth opening portion 132 opening at a position where the damaged plug can be discharged from first opening portion 121 or second opening portion 122 to outside jack 120.

1-2. Operation

An operation of electronic device 100 configured as described above will be described below.

Figure 3:
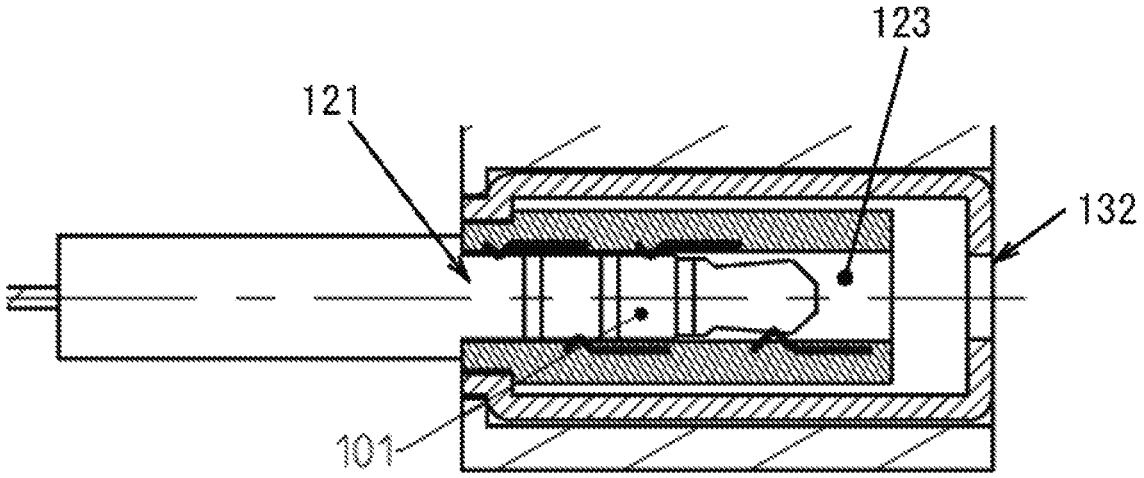
FIG. 3 is a sectional view during normal use in Embodiment 1.
Figure 4:
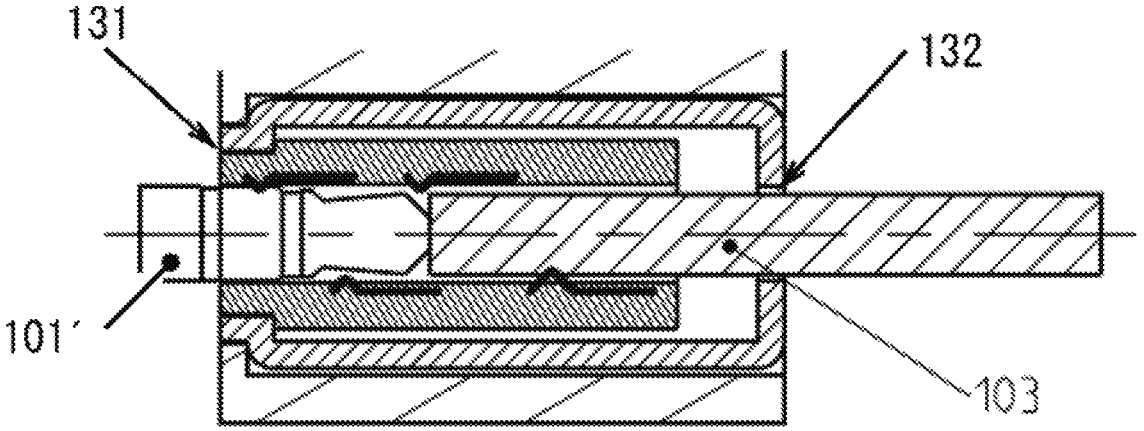
FIG. 4 is a sectional view when a damaged plug is removed in Embodiment 1.

During normal use, as illustrated in FIG. 3, plug 101 is inserted through first opening portion 121 of jack 120, and electrode 101 comes into contact with the electrode in through-hole 123, and thereby electrical communication is possible. In a case in which an external force or the like is applied to plug 101 in use and plug 101 is damaged inside through-hole 123, as illustrated in FIG. 4, damaged plug 101' can be picked up by inserting protruding device 103 through fourth opening portion 132.

Protruding device 103 using when picking up damaged plug 101' may be formed in a shape corresponding to that of fourth opening portion 132, or in consideration of workability, a tool using when the electronic device is attached to another product may be used instead. The tool is, for example, a screwdriver, a hexagon wrench, or the like. In order to pick up damaged plug 101', protruding device 103 may protrudes from third opening portion 131 to fourth opening portion 132. In this case, a diameter of fourth opening portion 132 may be designed according to a diameter of the tool. That is, if the tool is the screwdriver, the hole has to be a minimum diameter through which a shaft of the driver passes. By doing so, the number of tools required for an operator can be reduced, and a structure can be realized in which picking-up of the damaged plug 101' is easy while minimizing an influence of fourth opening portion 132 on an appearance of the device.

Housing 130 may be formed also as a housing of the product on which electronic device 100 is mounted. In FIG. 2, jack 120 is disposed inside housing 130, but it need not be disposed entirely inside. For example, jack 120 may have a longer length along first axis 110 than that of housing 130, and first opening portion 121 and second opening portion 122 may be formed outside housing 130.

1-3. Effects and the Like

As described above, in the present embodiment, in electronic device 100, damaged plug 101' left inside thereof can be picked up without being disassembled.

Embodiment 2

Hereinafter, Embodiment 2 will be described with reference to FIGS. 1 and 5 to 8.

2-1. Constitution

FIG. 1 illustrates an external view of a product example using electronic device 100 of Embodiment 2.

Figure 5:
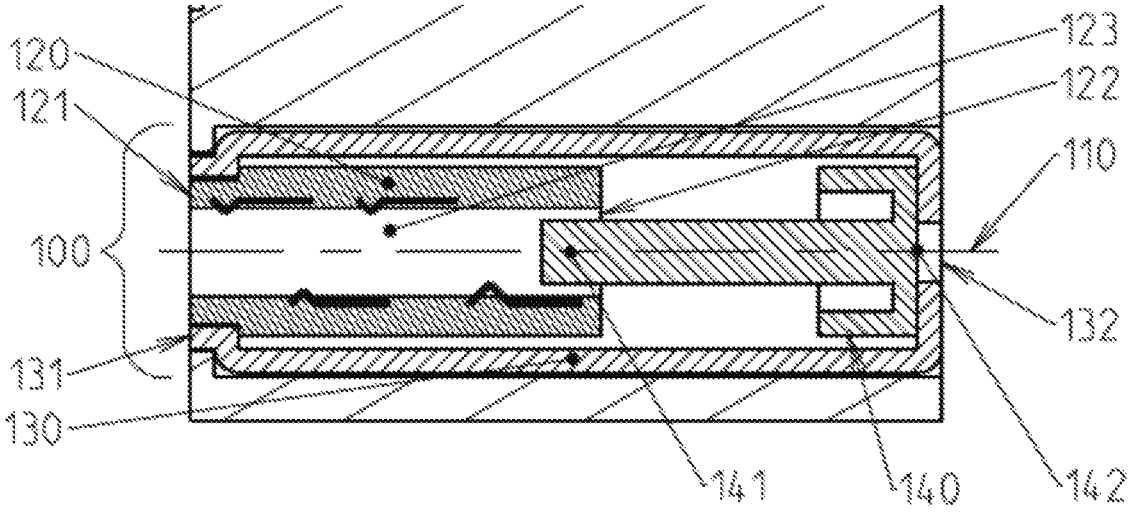
FIG. 5 is a sectional view of an electronic device in Embodiment 2.

FIG. 5 is a partial sectional view of electronic device 100 in Embodiment 2.

FIG. 5 is a sectional view of an electronic device 100 portion in FIG. 1, which is taken along the X-axis.

Electronic device 100 includes jack 120 into which plug 101 is inserted, and housing 130 into which jack 120 is incorporated. Jack 120 includes through-hole 123 formed along first axis 110 into which plug 101 is inserted, first opening portion 121 opening to a side of through-hole 123 into which plug 101 is inserted, and second opening portion 122 facing first opening portion 121 and opening on a side opposite to the side of through-hole 123 into which plug 101 is inserted. Electronic device 100 of the present embodiment has extrusion member 140 in housing 130. Extrusion member 140 includes projection portion 141 and operation portion 142, and is disposed at a position where projection portion 141 can be inserted from second opening portion 122 into through-hole 123 by operating operation portion 142. Housing 130 includes third opening portion 131 opening on a same side as first opening portion 121 and opening at a position where plug 101 can be inserted into first opening portion 121, and fourth opening portion 132 opening at a position where operation portion 142 of extrusion member 140 can be operated.

2-2. Operation

An operation of electronic device 100 configured as described above will be described below.

Figure 6:
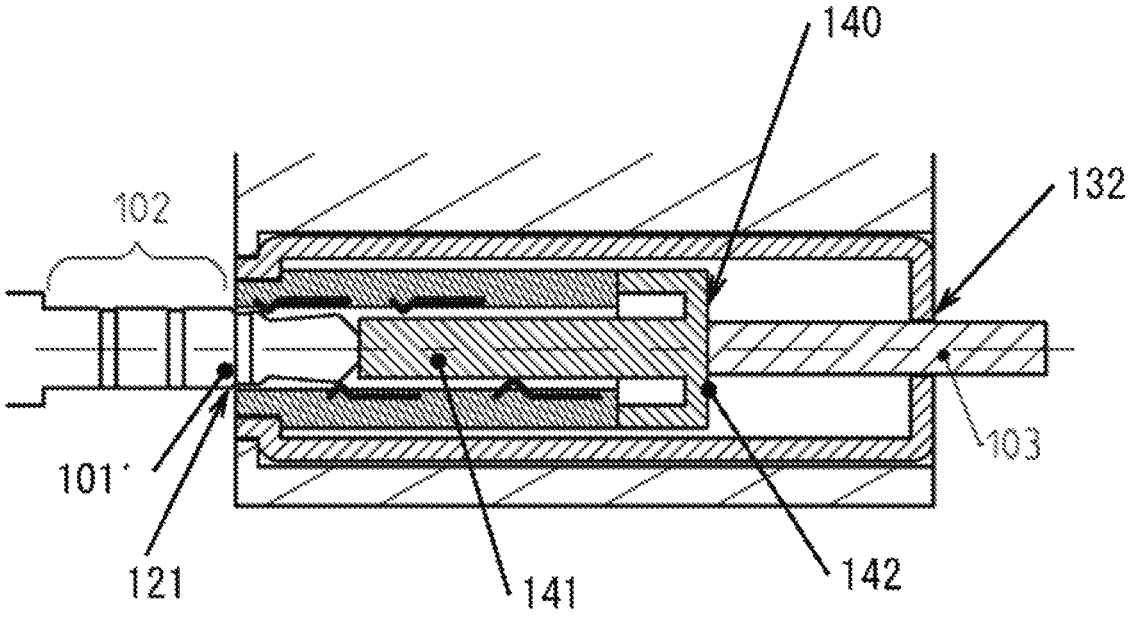
FIG. 6 is a sectional view when a damaged plug is removed in Embodiment 2.

In a case in which an external force or the like is applied to plug 101 in use and plug 101 is damaged inside through-hole 123, as illustrated in FIG. 6, by pushing operation portion 142 of extrusion member 140 from fourth opening portion 132 using protruding device 103 or a finger, projection portion 141 of extrusion member 140 is inserted into through-hole 123, and damaged plug 101' inside thereof can extruded and removed in a direction of first opening portion 121.

A shape of fourth opening portion 132 may be any shape as long as extrusion member 140 can be operated, so that a size thereof can be reduced so as not to impair an aesthetic appearance. Alternatively, in consideration of workability, fourth opening portion 132 may have a size large enough to receive a screwdriver or a hexagon wrench using when the electronic device is attached to another product, or may be set a size with which fourth opening portion 132 can be directly pressed by the finger of the operator. In a case in which a plurality of adjacent through-holes are formed in jack 120, one extrusion member 140 is provided with a plurality of projection portions 141, so that damaged plugs in the plurality of through-holes can be removed by one component. As for a length of projection portion 141 of extrusion member 140, as illustrated in FIG. 6, if the length is at least enough to push outermost portion 102 of the plug, it is not possible to remove damaged plug 101'.

Figure 7:
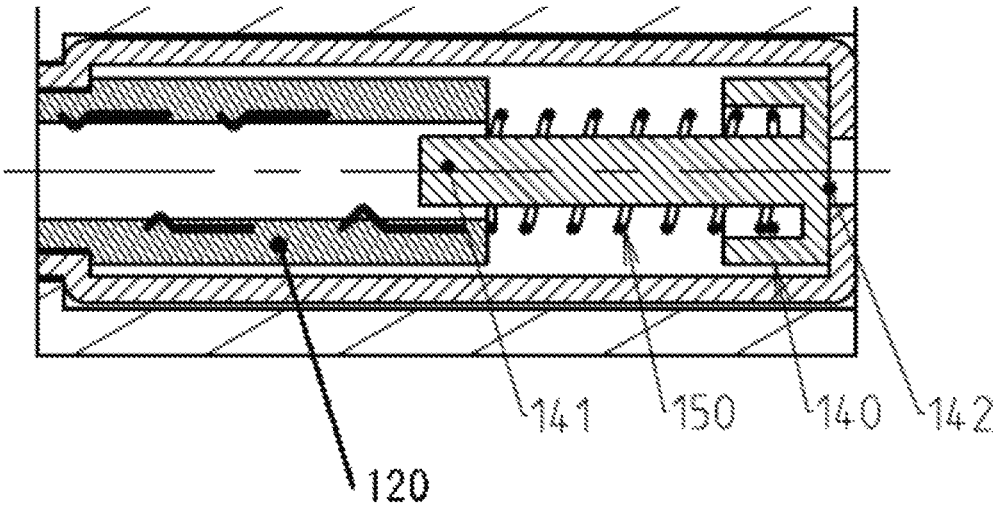
FIG. 7 is a sectional view of the electronic device having an elastic body in Embodiment 2 (Example 1)

As illustrated in FIG. 7, electronic device 100 may further include elastic body 150. When operation portion 142 of extrusion member 140 is not operated, extrusion member 140 is urged or pushed back from jack 120 in a direction of housing 130 by an elastic force of elastic body 150. Therefore, operation portion 142 of extrusion member 140 can close fourth opening portion 132. Therefore, foreign matters such as dust are prevented from entering the inside of electronic device 100 from fourth opening portion 132, and it is possible to reduce a possibility that the hole of fourth opening portion 132 impairs the aesthetic appearance. Elastic body 150 does not necessarily need to be in direct contact with jack 120 and extrusion member 140. Any structure may be used as long as a force acts so that extrusion member 140 is pushed back from jack 120 in a direction of housing 130. For example, a structure may be used in which elastic body 150 is not in direct contact with jack 120 and is hooked on a protrusion or the like provided in housing 130.

Figure 8:
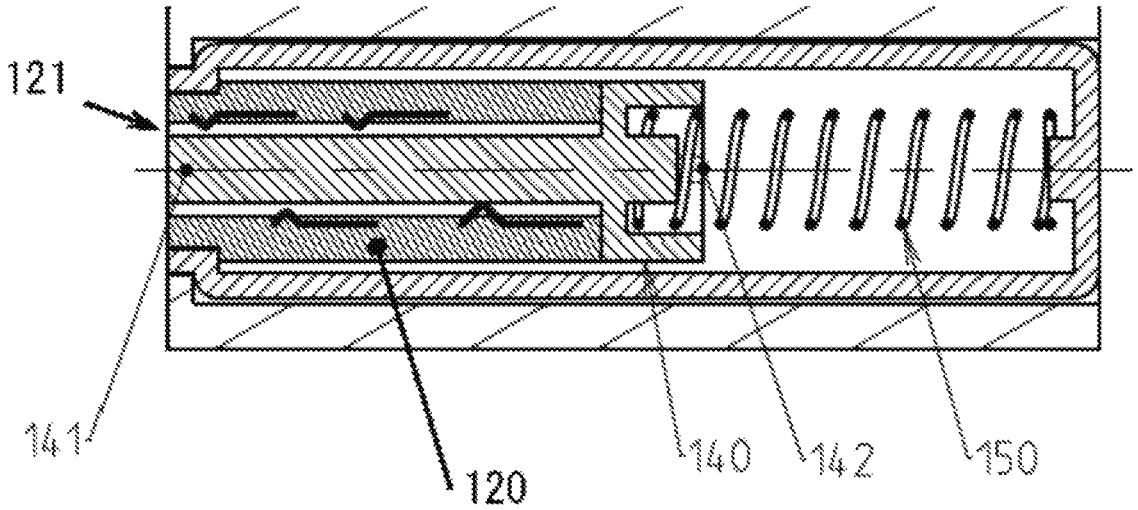
FIG. 8 is a sectional view of the electronic device having an elastic body in Embodiment 2 (Example 2)

As illustrated in FIG. 8, elastic body 150 may be disposed at a position where operation portion 142 of extrusion member 140 can be urged or pushed toward the jack 120 side or the first opening portion 121 side. In this case, when plug 101 is not inserted, through-hole 123 can be closed by projection portion 141 of extrusion member 140. Therefore, foreign matters such as dust can be prevented from entering the inside of electronic device 100 from first opening portion 121. In this case, fourth opening portion 132 may not be formed.

2-3. Effects and the Like

As described above, in the present embodiment, in electronic device 100, damaged plug 101' left inside can be picked up without disassembling electronic device 100. A shape of fourth opening portion 132 on housing 130 can be set regardless of the diameter of the plug by adding extrusion member 140. Further, it is possible to close fourth opening portion 132 and prevent the foreign matters from entering the inside thereof by adding elastic body 150.

Embodiment 3

Embodiment 3 will be described below with reference to FIGS. 1 and 9.

3-1. Constitution

FIG. 1 illustrates an external view of a product example using electronic device 100 of Embodiment 3.

Figure 9:
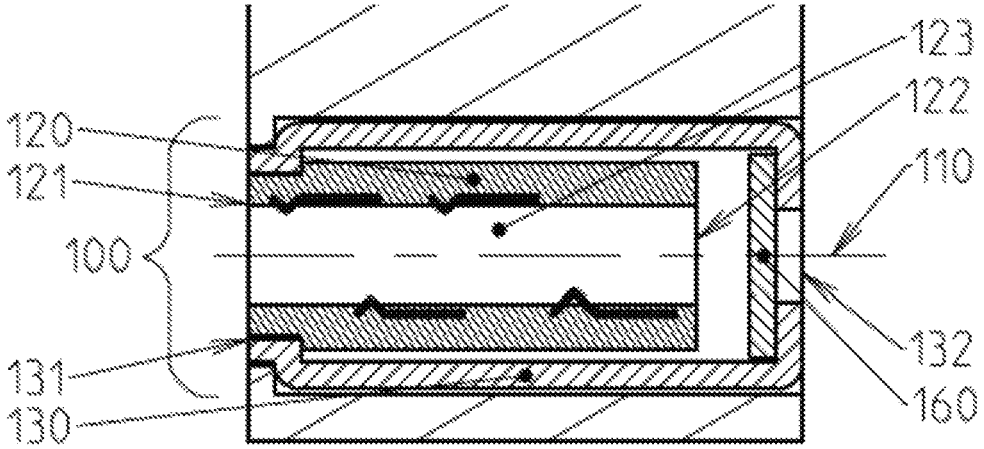
FIG. 9 is a sectional view of an electronic device having a partition in Embodiment 3.

FIG. 9 is a partial sectional view of electronic device 100 in Embodiment 3.

FIG. 9 is a sectional view of the electronic device 100 portion in FIG. 1, which is taken along the X-axis.

Electronic device 100 includes jack 120 into which plug 101 is inserted, and housing 130 into which jack 120 is incorporated. Jack 120 includes through-hole 123 formed along first axis 110, into which plug 101 is inserted, first opening portion 121 opening on a side of through-hole 123, into which plug 101 is inserted, and second opening portion 122 facing first opening portion 121 and opening on a side opposite to the side of through-hole 123 into which plug 101 is inserted. Housing 130 includes third opening portion 131 opening on a same side as first opening portion 121 and opening at a position where plug 101 can be inserted into first opening portion 121, and fourth opening portion 132 opening at a position where the damaged plug can be discharged from first opening portion 121 or second opening portion 122 to outside jack 120. In the present embodiment, partition 160 is provided which is fixed to either fourth opening portion 132 or a path from third opening portion 131 to fourth opening portion 132. Partition 160 has a valve that opens only in one direction from the third opening portion 131 side or the fourth opening portion 132 side.

3-2. Operation

An operation of electronic device 100 configured as described above will be described below.

In a case in which an external force or the like is applied to plug 101 in use and plug 101 is damaged inside through-hole 123, the damaged plug can be picked up by using a protruding device in an opening direction of the valve installed in partition 160 from third opening portion 131 or fourth opening portion 132.

The valve of partition 160 is made of, for example, rubber and has a mechanism that opens when a device is inserted from one side and is plugged again when the device is removed. However, the valve of partition 160 may have any mechanism as long as the mechanism provides a similar function. A position of partition 160 may be inconspicuous jack 120 instead of inside housing 130.

3-3. Effects and the Like

As described above, in the present embodiment, in electronic device 100, the damaged plug left inside thereof can be picked up without disassembling electronic device 100, and the valve opens only in a case in which the damaged plug is picked up. Therefore, otherwise, the opening portion of housing 130 can be closed to prevent the foreign matters such as dust from entering electronic device 100.

Embodiment 4

Hereinafter, Embodiment 4 will be described with reference to FIGS. 1, 10, and 11.

4-1. Constitution

FIG. 1 illustrates an external view of a product example using electronic device 100 of Embodiment 4.

Figure 10:
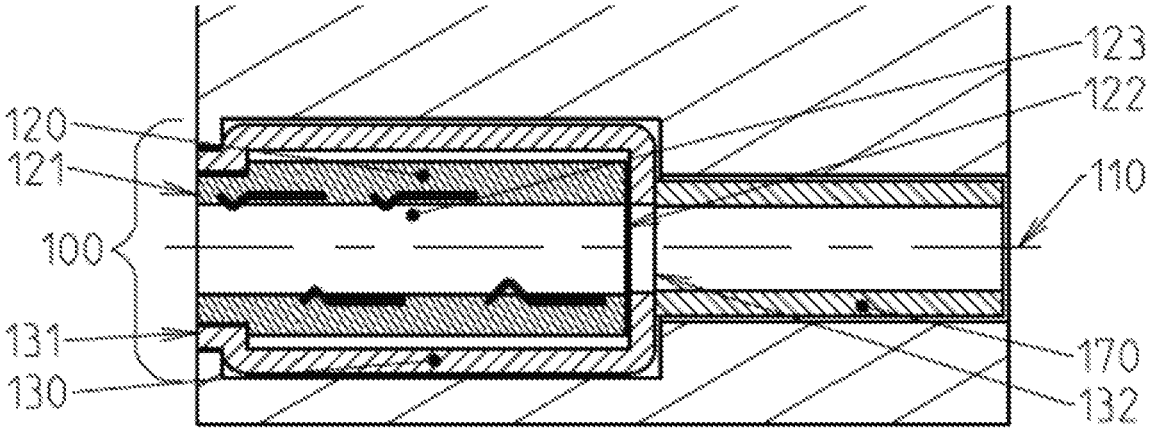
FIG. 10 is a sectional view of an electronic device having a plug holding component in Embodiment 4.

FIG. 10 is a partial sectional view of electronic device 100 in Embodiment 4.

FIG. 10 is a sectional view of the electronic device 100 portion in FIG. 1, which is taken along an X-axis.

Electronic device 100 includes jack 120 into which plug 101 is inserted, and housing 130 into which jack 120 is incorporated. Jack 120 includes through-hole 123 formed along first axis 110 into which plug 101 is inserted, first opening portion 121 opening to a side of through-hole 123 into which plug 101 is inserted, and second opening portion 122 facing first opening portion 121 and opening on a side opposite to the side of through-hole 123 into which plug 101 is inserted. Housing 130 includes third opening portion 131 opening on a same side as first opening portion 121 and opening at a position where plug 101 can be inserted into first opening portion 121, and fourth opening portion 132 opening at a position where the damaged plug can be discharged from first opening portion 121 or second opening portion 122 to outside jack 120. In the present embodiment, plug holding component 170 capable of holding the damaged plug picked up from fourth opening portion 132 is provided.

4-2. Operation

An operation of electronic device 100 configured as described above will be described below.

Figure 11:
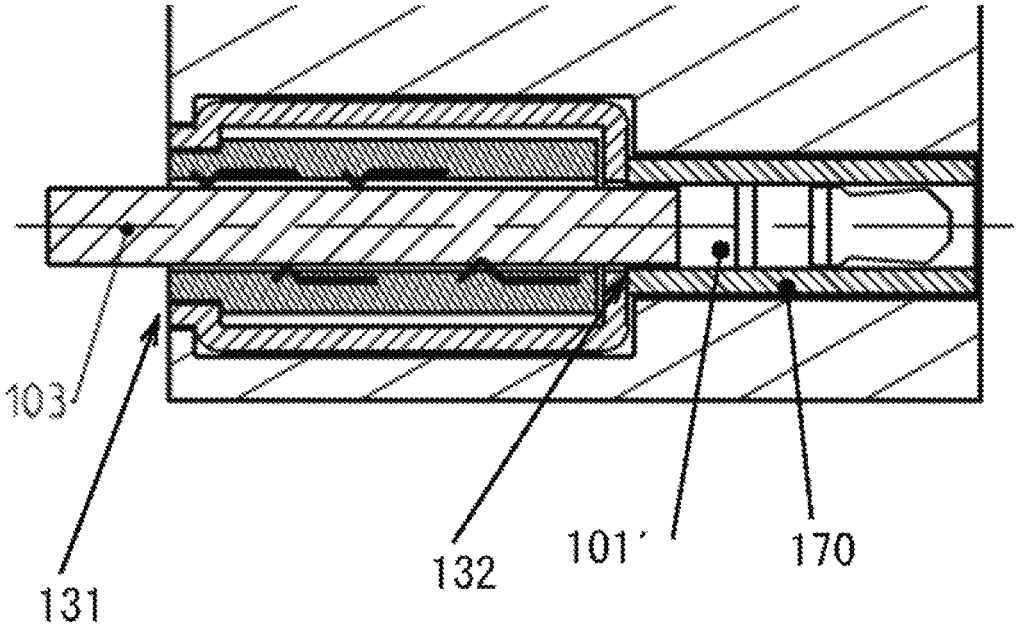
FIG. 11 is a sectional view when the plug holding component is used in Embodiment 4.

In a case in which an external force or the like is applied to plug 101 in use and plug 101 is damaged inside through-hole 123, as illustrated in FIG. 11, damaged plug 101' can be protruded by protruding device 103 in a direction from third opening portion 131 to fourth opening portion 132, and is held by plug holding component 170. If damaged plug 101' can be protruded to a state in which damaged plug 101' is held by plug holding component 170, it is not necessary to discharge damaged plug 101' by protruding device 103, and damaged plug 101' may be protruded by a newly inserted plug.

Plug holding component 170 has, for example, a hole that can hold damaged plug 101'. Plug holding component 170 is installed at a position where damaged plug 101' left inside jack 120 is pushed into a space inside plug holding component 170 when protruding device 103 or the newly inserted plug is inserted and protruded from the hole of third opening portion 131. An internal space of plug holding component 170 has a hole having a same diameter as that of plug 101, and is formed so as to have an interference fit mechanism inside the hole. Therefore, damaged plug 101' pushed into plug holding component 170 may be held. Therefore, when an impact such as vibration is applied to electronic device 100, it is possible to prevent the damaged plug from returning to the jack 120 side, or damaged plug 101' from coming off from plug holding component 170.

Plug holding component 170 does not necessarily have to exist alone, but may be formed integrally with housing 130, or may be formed integrally with the housing of the product to which electronic device 100 is attached. If plug holding component 170 has a function of holding the damaged plug, a shape like a tray (saucer), of which an outer shape does not have the cylindrical hole as illustrated in FIGS. 10 and 11, and which receives damaged plug 101' from below, may be provided.

4-3. Effects and the Like

As described above, in the present embodiment, electronic device 100 can be continuously used without disassembling the product even in a case in which there is a damaged plug left inside thereof.

The present disclosure is applicable to an electric device capable of using a jack electrically connected to an inserted plug. Specifically, the present disclosure is applicable to the electric device such as a television, a personal computer, a smartphone, or a mobile phone.

REFERENCE NUMERALS

100: electronic device
101: plug
102: outermost portion of plug
103: protruding device
110: first axis
120: jack
121: first opening portion
122: second opening portion
123: through-hole
130: housing
131: third opening portion
132: fourth opening portion
140: extrusion member
141: projection portion
142: operation portion
150: elastic body
160: partition
170: plug holding component

What is claimed is:

1. An electronic device comprising:
a jack including a first opening portion through which a plug can be inserted along a first axis, and coming into contact with the plug at an electrode; and
a housing formed separately from the jack,
wherein the jack includes a second opening portion facing the first opening portion along the first axis, and a through-hole connecting the first opening portion and the second opening portion along the first axis, and
wherein the housing includes
a third opening portion opening on the same side as the first opening portion and opening at a position where a plug can be inserted from outside the housing into the first opening portion,
a fourth opening portion facing the third opening portion along the first axis and opening at a position where the plug can be discharged to an outside of the housing through the second opening portion, and
a partition fixed to either the fourth opening portion or a path from the third opening portion to the fourth opening portion,
wherein the partition has a valve opening only in one direction from the third or fourth opening portion side.

2. The electronic device of claim 1, further comprising:
a plug holding mechanism holding the plug extruded from the fourth opening portion.

3. An electronic device comprising:
a jack including a first opening portion through which a plug can be inserted along a first axis, and coming into contact with the plug at an electrode;
a housing formed separately from the jack,
an extrusion member having a projection portion and an operation portion,
wherein the jack includes a second opening portion facing the first opening portion along the first axis, and a through-hole connecting the first opening portion and the second opening portion along the first axis,
wherein the extrusion member is disposed at a position where the projection portion can be inserted into the through-hole from the second opening portion by operating the operation portion, and
wherein the housing includes:
a third opening portion opening on the same side as the first opening portion and opening to a position where the plug can be inserted from outside the housing into the first opening portion, and
an elastic body disposed so as to urge the extrusion member in a direction toward or away from the jack.

4. The electronic device of claim 3,
wherein the elastic body pushes the operation portion of the extrusion member so that an end point of the projection portion of the extrusion member is located in a space closer to the first opening portion than the second opening portion.

5. An electronic device comprising:
a jack including a first opening portion through which a plug can be inserted along a first axis, and coming into contact with the plug at an electrode;
a housing formed separately from the jack,
an extrusion member having a projection portion and an operation portion,
wherein the jack includes a second opening portion facing the first opening portion along the first axis, a through-hole connecting the first opening portion and the second opening portion along the first axis, and
an elastic body extruding the extrusion member from the second opening portion in a direction of the fourth opening portion,
wherein the housing includes:
a third opening portion opening on the same side as the first opening portion and opening to a position where the plug can be inserted from outside the housing into the first opening portion, and
a fourth opening portion facing the third opening portion and opening at a position where the operation portion of the extrusion member can be operated,
wherein the extrusion member is disposed at a position where the projection portion can be inserted into the through-hole from the second opening portion by operating the operation portion, and
wherein the extrusion member is disposed so that the operation portion closes the fourth opening portion by elasticity of the elastic body when the operating portion is not operated.

6. The electronic device of claim 5,
wherein a shape of the fourth opening portion of the housing is a shape having a diameter smaller than a diameter of the plug.

7. The electronic device of claim 5, wherein the fourth opening portion faces the third opening portion along the first axis.

8. An electronic device comprising:
a jack including a first opening portion through which a plug can be inserted along a first axis, and coming into contact with the plug at an electrode;
a housing formed separately from the jack,
an extrusion member having a projection portion and an operation portion,
wherein the jack includes a second opening portion facing the first opening portion along the first axis, and a through-hole connecting the first opening portion and the second opening portion along the first axis,
wherein the housing includes a third opening portion opening on the same side as the first opening portion and opening to a position where the plug can be inserted from outside the housing into the first opening portion, wherein the extrusion member is disposed at a position where the projection portion can be inserted into the through-hole from the second opening portion by operating the operation portion, and an elastic body urging the extrusion member toward the first opening portion.

9. The electronic device of claim 8, wherein the extrusion member is disposed so that the projection portion closes the through-hole by urging of the elastic body.

10. An electronic device comprising:

a jack including a first opening portion through which a plug can be inserted along a first axis, and coming into contact with the plug at an electrode;

a housing formed separately from the jack, an extrusion member having a projection portion and an operation portion, wherein the jack includes a second opening portion facing the first opening portion along the first axis, and a through-hole connecting the first opening portion and the second opening portion along the first axis, wherein the housing includes a third opening portion opening on the same side as the first opening portion and opening to a position where the plug can be inserted from outside the housing into the first opening portion, wherein the extrusion member is disposed at a position where the projection portion can be inserted into the through-hole from the second opening portion by operating the operation portion, and an elastic body urging the extrusion member in a direction opposite to the first opening portion.

11. The electronic device of claim 10, wherein the housing includes a fourth opening portion facing the third opening portion along the first axis and opening at a position where the operation portion of the extrusion member can be operated, and wherein the extrusion member is disposed so that the operation portion closes the fourth opening portion by urging of the elastic body.

* * * * *